United States Patent [19]

Gallenschutz et al.

[11] Patent Number: 5,076,013

[45] Date of Patent: Dec. 31, 1991

[54] SECURITY REVOLVING DOOR ASSEMBLY FOR PERSONS

[75] Inventors: Thomas Gallenschutz, Bühl/Baden; Erwin Hochtstuhl, Böhl; Roland Ebert, Achern, all of Fed. Rep. of Germany

[73] Assignee: Gallenschütz Metallbau GmbH, Bühl/Baden, Fed. Rep. of Germany

[21] Appl. No.: 622,818

[22] Filed: Dec. 4, 1990

[30] Foreign Application Priority Data

Dec. 5, 1989 [DE] Fed. Rep. of Germany ..... 3940176

[51] Int. Cl.[5] ..... E05D 15/02

[52] U.S. Cl. ..... 49/42

[58] Field of Search ..... 49/42, 43, 31, 35; 109/2, 3, 8

[56] References Cited

U.S. PATENT DOCUMENTS

| | | | |
|---|---|---|---|
| 1,119,080 | 12/1914 | Hope-Jones | 49/43 X |
| 1,570,927 | 1/1926 | Spottswood | 109/3 |
| 2,090,520 | 8/1937 | Schneider | 109/3 X |
| 2,186,385 | 1/1940 | Lockart | 49/42 X |
| 2,348,900 | 5/1944 | Hagenbook | 49/42 X |
| 3,285,209 | 11/1966 | Pae | 49/42 X |
| 4,154,023 | 5/1979 | Carroll | 49/43 X |
| 4,295,297 | 10/1981 | Carroll et al. | 49/42 |
| 4,341,165 | 7/1982 | Calmoritt et al. | 49/42 X |
| 4,530,183 | 7/1985 | Heise et al. | 49/42 |
| 4,534,131 | 8/1985 | Blackston et al. | 49/42 |
| 4,557,073 | 12/1985 | Sandling | 49/42 X |
| 4,627,193 | 12/1986 | Schwarz | 49/42 |
| 4,796,542 | 1/1989 | Lee | 49/42 X |

FOREIGN PATENT DOCUMENTS 2901494 4/1980 Fed. Rep. of Germany .

*Primary Examiner*—Rodney M. Lindsey
*Assistant Examiner*—Jerry Redman
*Attorney, Agent, or Firm*—McGlew & Tuttle

[57] ABSTRACT

In a security revolving door assembly for persons, comprising one blocking sector (13) and one passage sector (12) or two passage sectors (12), a motor-driven revolving door (10), which can be blocked by means of a braking device controllable by an electronic control unit, is arranged in the door housing. Peripheral identification devices (46, 47) are connected to the electronic control unit. To ensure reliable entry and exit control, blocking, which cannot be overcome at certain angular positions of the revolving door (10), but which always makes it possible to leave the door housing, is provided. This is achieved by means of a blocking disk (23) which is in a rigid rotating connection with the revolving door (10) and has, in a blocking plane, at least one stop face pair (26/1–26/2, 27/1–27/2, 28/1–28/2) with two stop faces (26/1 through 28/2), each acting in one reaction direction. Two stationary locking bolts (24 and 25), which can be brought into blocking position between two stop faces (26/1 through 28/2), are associated with the blocking disk (23). Due to their special arrangement relative to the distance between two stop faces (26/1 through 28/2), the revolving door (10) is freely rotatable through half the sector angle of the passage sector (12) when the locking bolt (24, 25) has dropped in.

8 Claims, 10 Drawing Sheets

FIG. 1
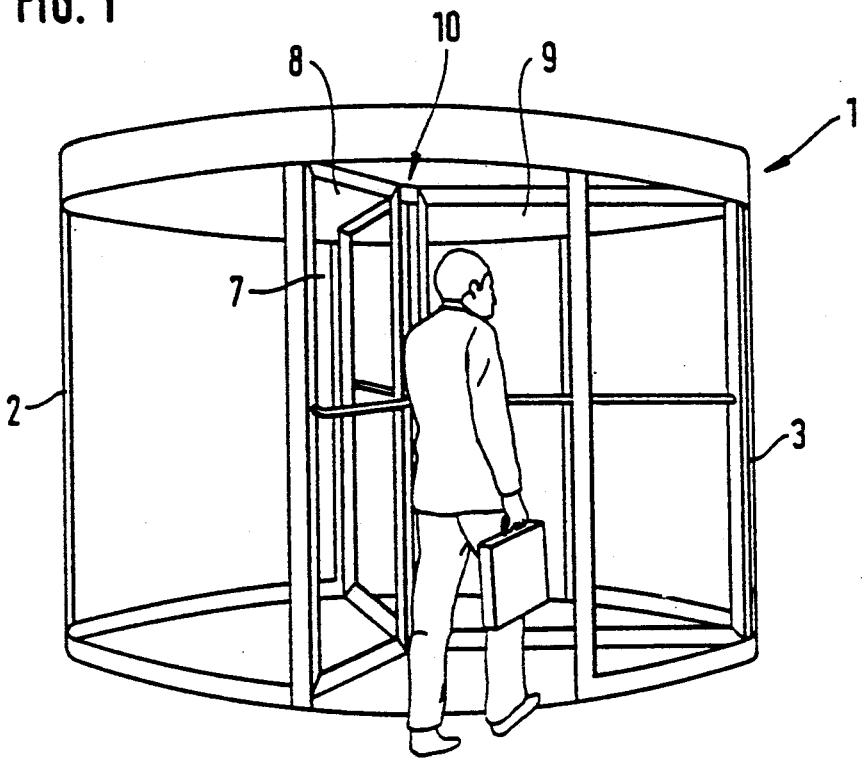
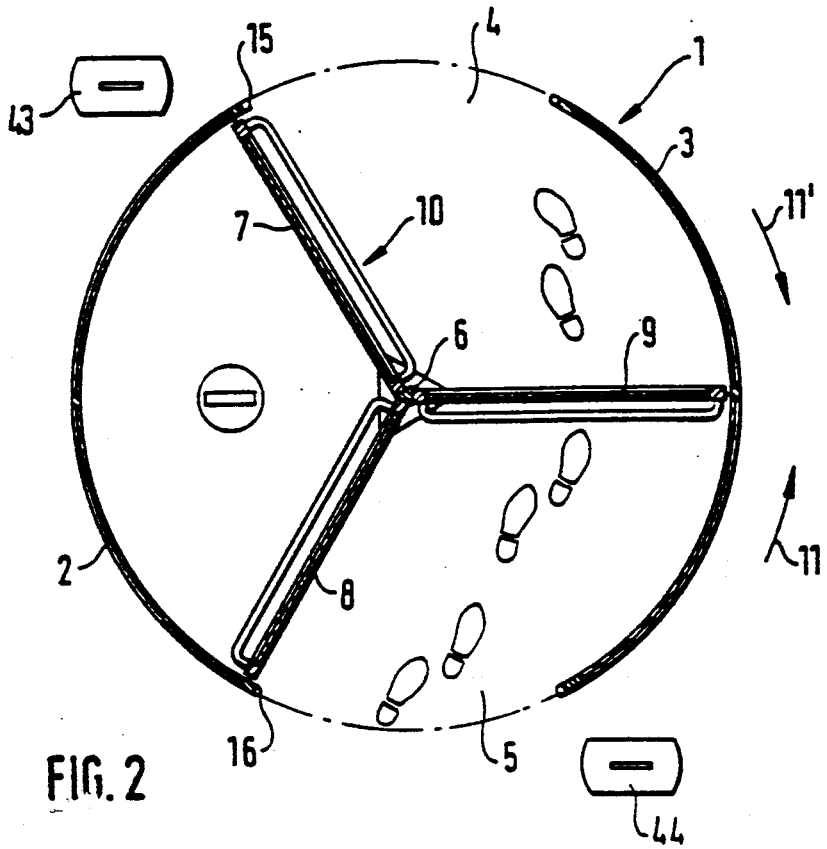
FIG. 2

FIG. 5
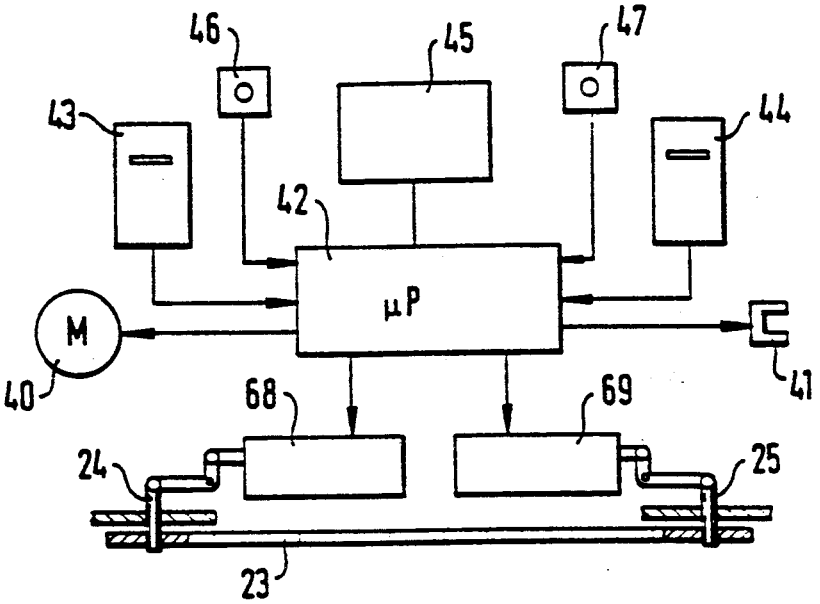
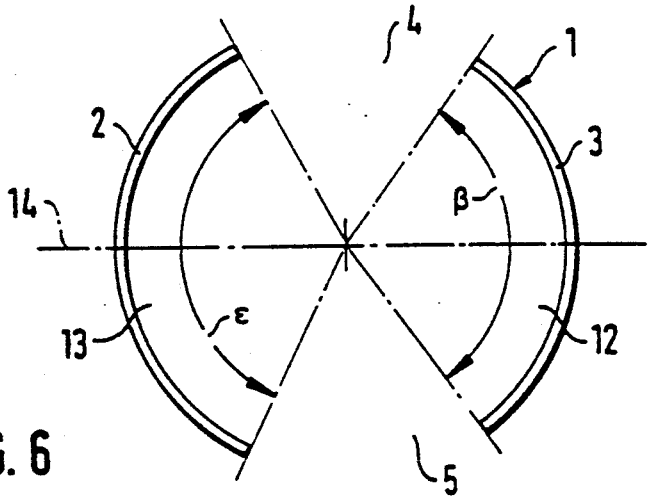
FIG. 6
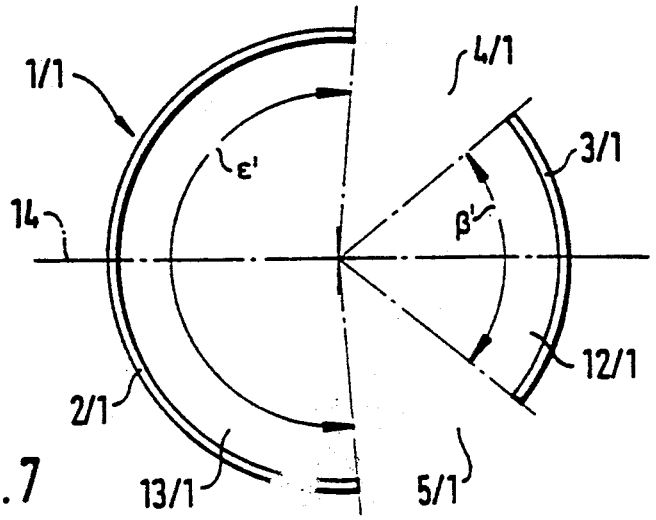
FIG. 7

SECURITY REVOLVING DOOR ASSEMBLY FOR PERSONS

FIELD OF THE INVENTION

The present invention pertains to a security revolving door assembly for an essentially cylindrical door housing which consists of two wall shells defining one blocking sector and one passage sector or two passage sectors. The wall shells leave open opposite passage openings. The door housing is provided with a passage release member which can be rotated from defined resting positions around the vertical central axis and can be driven by a motor. The housing has a revolving door with up to four door flaps or one revolving cylinder with at least one passage opening, wherein the passage release member can be blocked by means of a braking device that can be controlled by an electronic control unit, especially a microprocessor, and wherein peripheral identification devices, e.g., card readers, and/or monitoring sensors arranged in the passage sectors or in the blocking sector are connected to the electronic control unit.

BACKGROUND OF THE INVENTION

In a prior-art security revolving door assembly of this class (West German Offenlegungsschrift No. DE-OS No. 29,01,494), the revolving door is provided with a hydraulic speed control device and an electromagnetic braking mechanism. This braking mechanism is controlled by a pressure-sensitive device installed in the floor under the revolving door in the blocking sector of the door housing such that the revolving door can be blocked to prevent it from revolving. The pressure-sensitive device extends over one blocking sector. Entry over the pressure-sensitive device in the blocking sector causes a signal to be sent to an electronic relay which puts the braking mechanism into operation, thus causing blocking of the revolving door.

To prevent accidents, the braking device is designed such that its braking effect does not lead to firm blocking of the revolving door, but the revolving door can be rotated manually by applying a larger torque despite the braking device being turned on.

Since the revolving door can still be rotated by human force while the braking device is being activated, one person is able to pass through the blocking sector in an unauthorized manner. However, it is thus impossible to guarantee reliable entry and exit control. If this is to be achieved with the prior-art braking or blocking devices, these must be designed such that turning the revolving door by one person is totally impossible in case of blocking. However, it may happen in individual cases that a person who has reached the blocking sector by taking a long step and is now standing on the pressure-sensitive device is no longer able to get out of the blocking sector. Since the entire floor area of the blocking sector is covered by the pressure- sensitive device, the person located in the blocking sector is also unable to release the blocking of the revolving door himself and to leave the blocking sector of the revolving door.

This prior-art security revolving door assembly for persons makes no provisions for controlling the passage sector.

SUMMARY AND OBJECTS OF THE INVENTION

It is an object of the present invention to design a security revolving door assembly of this class such that both reliable entry and exit control is guaranteed and a person located in the blocking sector or the passage sector, in the case of blocking of the passage release member against unauthorized passage, will be able to leave the door housing.

According to the present invention as an additional blocking device is provided in the form of a blocking disk, which is in rigid rotary connection with the rotatable passage release member either directly or via a gear mechanism, and which has—on a circular arc around the central axis of the door housing—at least one stop face pair with one stop face acting in the forward rotation direction and one stop face acting in the reverse rotation direction. The blocking disk is associated with two stationary locking bolts, which can be controlled by the control unit and can be placed alternately into the blocking disk between two stop faces of a stop face pair, wherein the distance between the two stop faces of each stop face pair corresponds to a free-wheeling angle that is great enough to enable the passage release member to rotate freely through half the sector angle when a locking bolt (24, 25) has been placed into the blocking disk.

The solution according to the present invention not only accomplishes the task of the present invention in all its parts with the necessary reliability of operation, but it also ensures that—in the case of blockage of the passage release member in one rotation direction—the passage release member, when blocked in one rotation direction, can be rotated manually in the opposite rotation direction by at least so much that the risk of a person being trapped in the door housing is ruled out. However, by providing a second locking bolt, blockage of the passage release member in the reverse rotational direction can also be brought about during the passage of an authorized person, before the passage release member reaches its next resting position, but the passage release member is not prevented from rotating further until the passage opening is released. In addition, it can also be guaranteed that blocking cannot occur when a vertical delimiting edge of the passage release member is located at a distance from a delimiting edge of a wall shell at which there is a risk of squeezing. In addition, the means with which the task is accomplished are simple and compact, and their function is easily manageable.

While the stop faces of the blocking disk can be produced in a very simple manner by forming stop faces of ends of one or more arc-shaped openings of the blocking disk, the embodiment including a number of stop face pairs of one blocking disk corresponding to the number of the defined resting positions of the passage release member and the angular distances of the individual stop face pairs or recesses corresponding to the angular distances of the passage release members, offers the essential advantage that highly accurate blocked positions of the passage release member can be achieved at minimal expense, using only one blocking disk and only two locking bolts.

While it is also possible, in principle, to guarantee that only one locking bolt can be placed between the stop faces of one stop face pair at any one time, by means of, e.g., mechanical or electronic control devices, the embodiment including two blocking bolts having an angular distance from each other which is greater than the distance angle of the two stop faces of one stop face pear by at least so much that one of the two locking bolt at a time can be placed between the two stop faces of one or more stop face pears, provides a very simple possibility for meeting this condition.

The embodiment including a passage release member having more than two defined resting positions wherein two locking bolts are arranged such that in each defined resting position of the passage release member, one of the locking bolts can drop into the blocking disk immediately behind the stop face acting in the reverse rotation direction, makes it possible to block the passage release member in each of its resting positions in a defined rotation direction, for example, in the direction of entry to a room, in order to ensure, e.g., that not more than a defined number of persons shall be able to enter or leave the protected room.

The embodiment including a revolving door with three or four door flaps, the wall shell defining the passage sector extending symmetrically the resting position of the door flap through a sector angle that is smaller than the door flap angle by at most so much that a maximum difference gap of 20cm will be obtained, ensures optimal width of the passage openings in the wall shells of the door housing while maintaining the desired reliability of control.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view of a security revolving door assembly;

FIG. 2 is a horizontal sectional view of the security revolving door assembly according to FIG. 1;

FIG. 5 is a simplified circuit diagram of the control device according to the invention;

FIG. 6 is a schematic view showing the wall shells of a security revolving door assembly provided with a three-flap revolving door with one passage sector and one blocking sector;

FIG. 7 shows a simplified representation of the wall shells of a security revolving door assembly provided with a four-flap revolving door with one passage sector and one blocking sector;

FIG. 11*a* through FIG. 11*l* are views showing the revolving door according to FIG. 11 in twelve different positions;

DETAILED DESCRIPTION OF THE PREFERRED EMBODIMENTS

Figure 3:
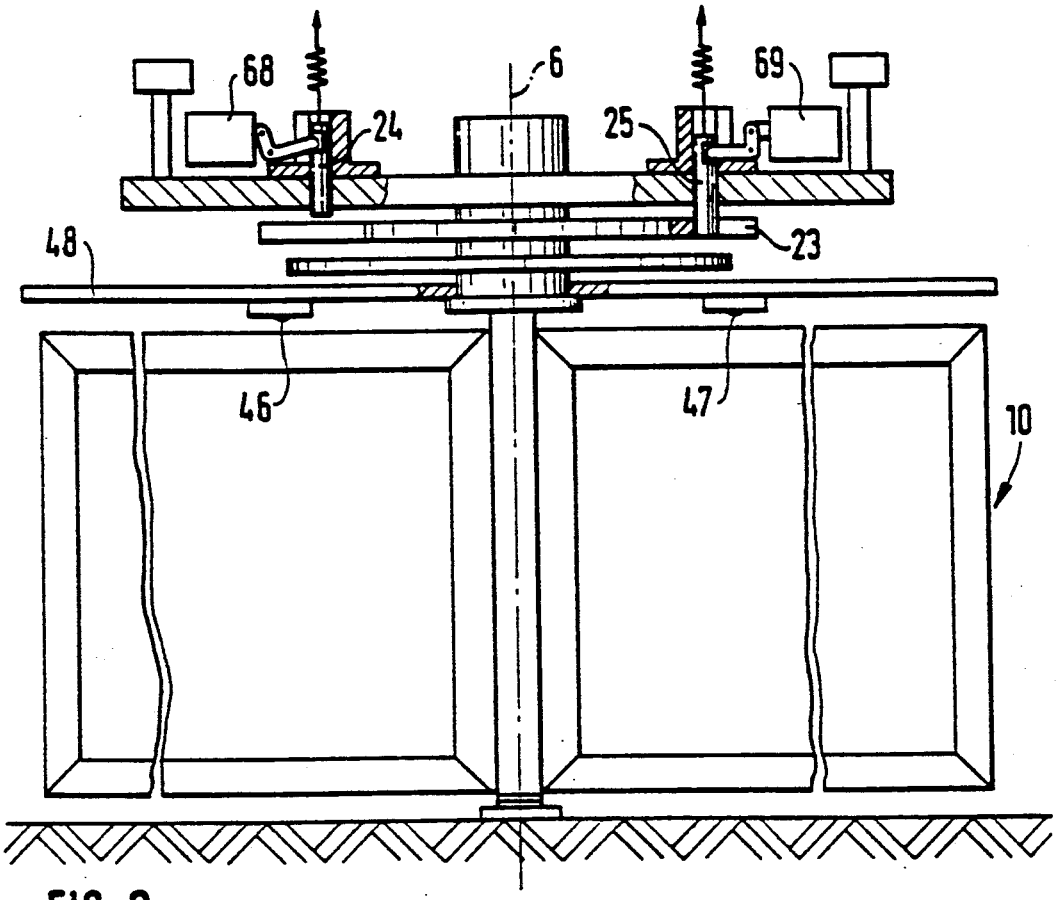
FIG. 3 is a simplified representation of a revolving door with a blocking device.
Figure 4:
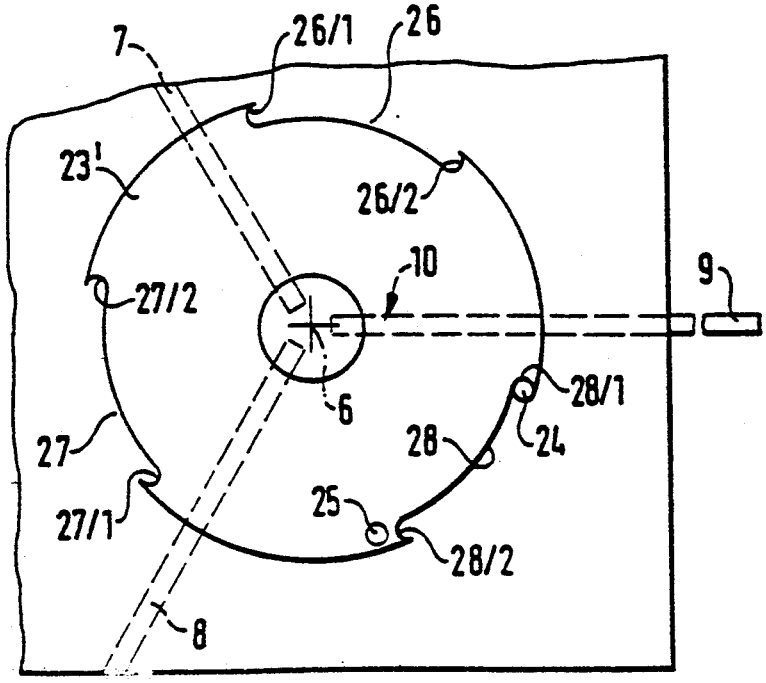
FIG. 4 is a top view of a blocking disk of the blocking device shown in FIG. 3.

Referring to the drawings in particular, FIGS. 1 and 2 show schematically a security revolving door assembly with a cylindrical door housing 1 which is formed by two approximately diametrically opposed, glazed wall shells 2 and 3 which leave open two opposite passage openings 4 and 5. A revolving door 10, which can be rotated on a vertical central axis 6, is provided with three door flaps 7, 8, and 9, and can be driven by an electric motor in two directions indicated by the arrows 11 and 11', is provided as a passage release member in the door housing 1. A passage sector 12 extending over an angle beta ($\beta$) of ca. 110° (FIG. 6) and, opposite it, a blocking sector 13 extending over an angle epsilon ($\epsilon$) of ca. 130° are thus also defined at the same time. It is recognizable that the angle beta over which the passage sector 12 extends is smaller than the angle epsilon of the blocking sector 13, and that the two passage openings extend over an opening angle of 60° each. As is apparent from FIG. 9, the three door flaps 7, 8, and 9 enclose angular distances phi ($\rho$) of 120° each, which are equal to the angular distance alpha ($\alpha$) between the individual defined resting positions of the revolving door 10. This means that the revolving door 10 rotates through 120° from the resting position shown in FIG. 9 during each regular passage in the direction of arrow 11 or in the direction of arrow 11', to subsequently assume the next resting position. It can also be recognized that in the resting position, one of the door flaps 7, 8 or 9 is located in the plane of the bisector 14 of the passage sector 12, i.e., of the angle beta, which causes the other two door flaps 7 and 8 assume a symmetrical position to the angle bisector 14, in which position they are within the delimiting edges 15 and 16 of the wall shell 2.

Figure 10:
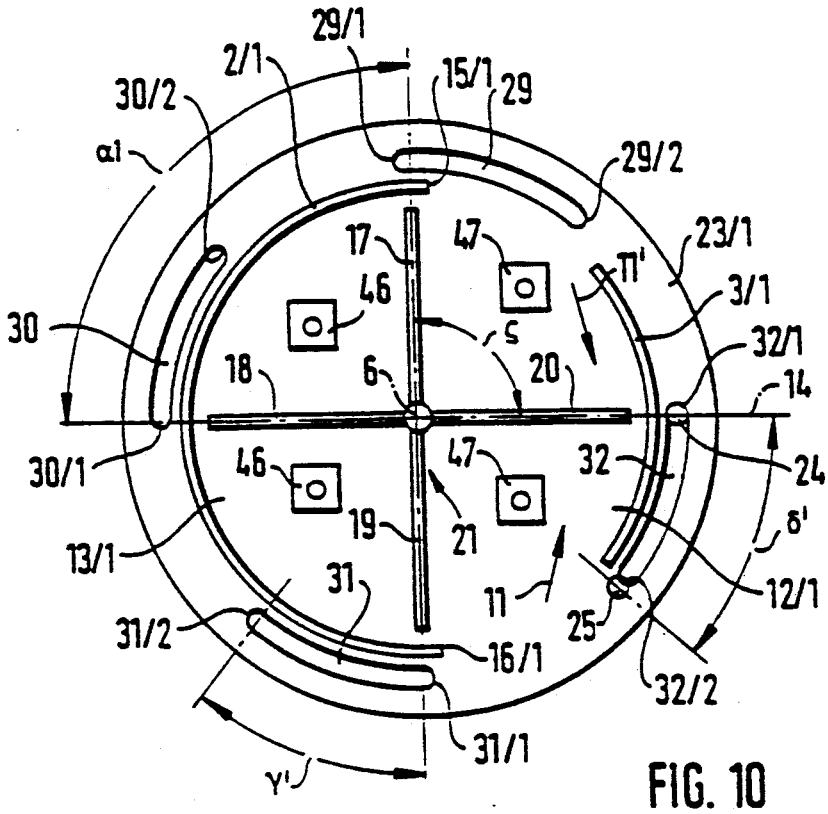
FIG. 10 is a schematic top view of a security revolving door assembly for an arrangement provided with a four-flap revolving door and a blocking disk arranged concentrically to it.

In the embodiment according to FIGS. 7 and 10, a different door housing 1/1 is provided, in which a revolving door 21 with four door flaps, which is again rotatable around the vertical central axis 6 in the two directions indicated by the arrows 11 and 11', and can be driven by a motor, is arranged as the passage release member. The wall shell 3/1 defining the passage sector 12/1 here extends over an angle beta'($\beta'$) of ca. 95°, while the wall shell 2/1 defining the blocking sector 13/1 extends over an angle epsilon'($\epsilon'$) of ca. 185°, so that the passage openings 4/1 and 5/1 have an opening angle of ca. 40° each. The two wall shells 2/1 and 3/1 are symmetrical to the common bisector 14 of the angles beta' and epsilon', whereas the defined resting positions of the four-flap revolving door 21 are again arranged such that in each resting position, e.g., one door flap 20 in the area of the passage sector 12/1 and one door flap 18 in the area of the blocking sector 13/1, is located in the plane of the common bisector 14, while the other two door flaps 17, 19, which extend at right angles thereto, are located within the delimiting edges 15/1 and 16/1 of the wall shell 2/1 defining the blocking sector 13/1.

Figure 8:
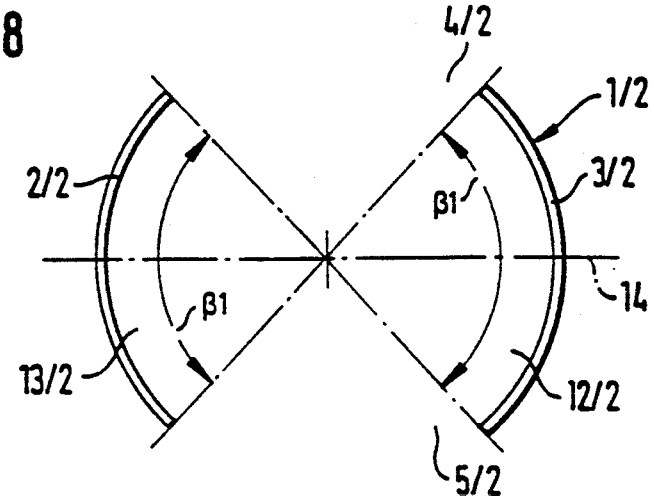
FIG. 8 is a simplified representation of the wall shells of a security revolving door assembly for persons, provided with a four-flap revolving door and two passage sectors.
Figure 11:
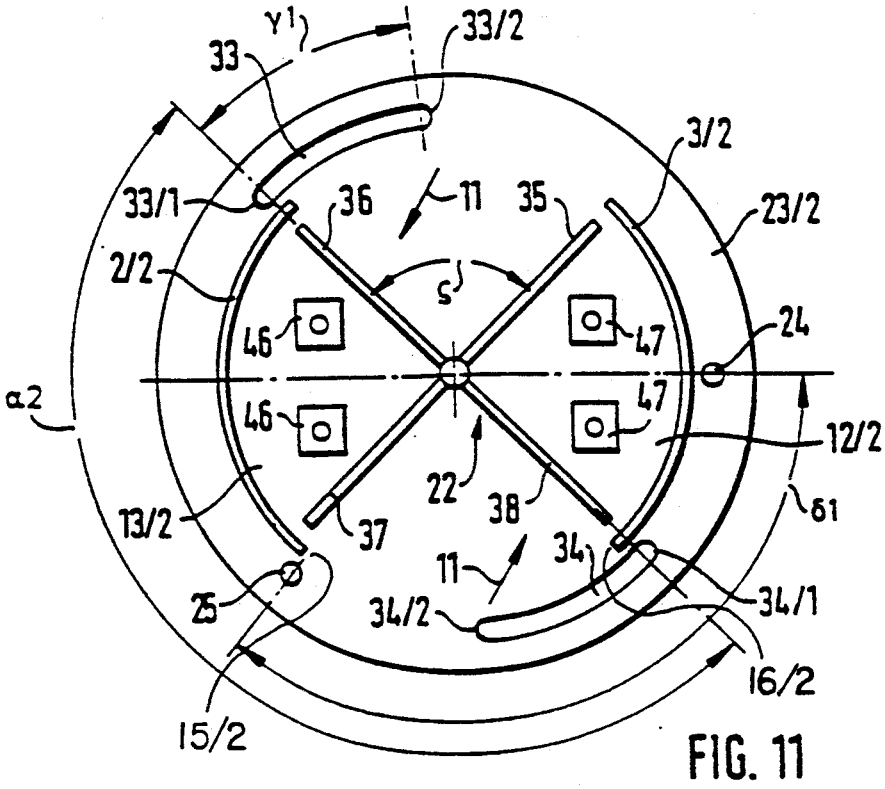
FIG. 11 is a schematic top view of another security revolving door assembly for persons with a four-flap revolving door and a blocking disk arranged concentrically to it.

FIGS. 8 and 11 show another embodiment of a security revolving door assembly of this class, in which the cylindrical door housing ½ has two diametrically opposed wall shells 2/2 and 3/2 of equal size, each of ($\beta$1) which defines a passage sector 12/2 and 13/2, each extending over an angle betal of beta 1 ca. 95°, and leaves open the passage openings 4/2 and 5/2, which are also located exactly diametrically opposite each other and have an opening angle of 85° each. The revolving door 22 provided as a passage release member here again has four door flaps 35, 36, 37, and 38, which are arranged at right angles to one another and thus enclose a door flap angle phi ($\rho$) of 90°. In this embodiment, the revolving door 22 can be rotated only in the direction of arrow 11 and is driven by a motor. This revolving door 22 also has only two resting positions, which are offset at 180° relative to one another and are located such that the common angle bisector 14 of the two passage sectors 12/2 and 12/3 forms the angle bisector between two door flaps, i.e., each of the door flaps 36 and 37 or 35 and 38 is in a symmetrical position relative to the angle bisector 14. As is apparent from FIG. 11, the end edges of the door flaps 35 through 38 are located within the respective end edges 15/2 and 16/2 of the wall shells 2/2 and 3/2 in the resting positions of the revolving door 22 in this case as well.

Figure 12:
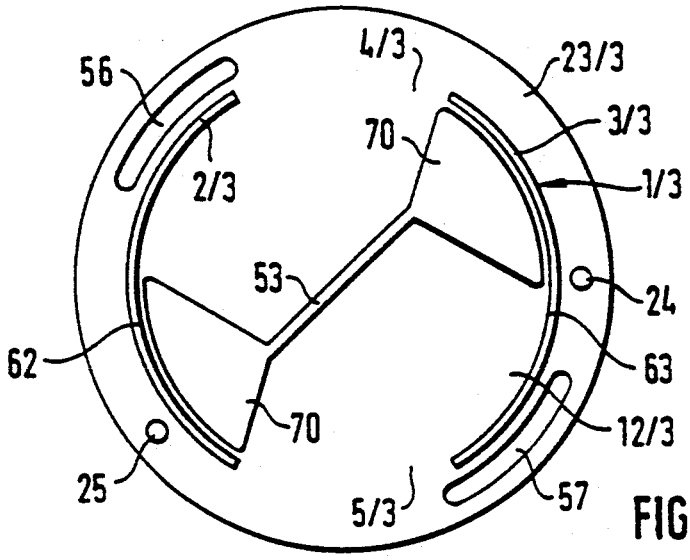
FIG. 12 is a schematic top view of a security revolving door assembly for a revolving door having only two flaps, whose flap ends are provided with asymmetric blocking segments.
Figure 13:
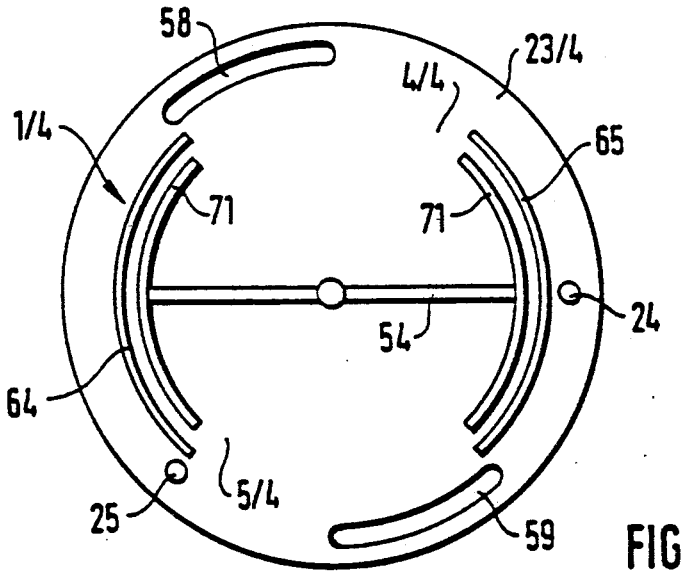
FIG. 13 is a schematic top view of a security revolving door assembly for persons with a revolving door that also has only two flaps, but whose flap ends are provided with symmetrical blocking segments; and, FIG. 14 is a schematic top view of a security revolving door assembly for a revolving cylinder acting as a passage release member, which is also associated concentrically with a blocking disk.
Figure 14:
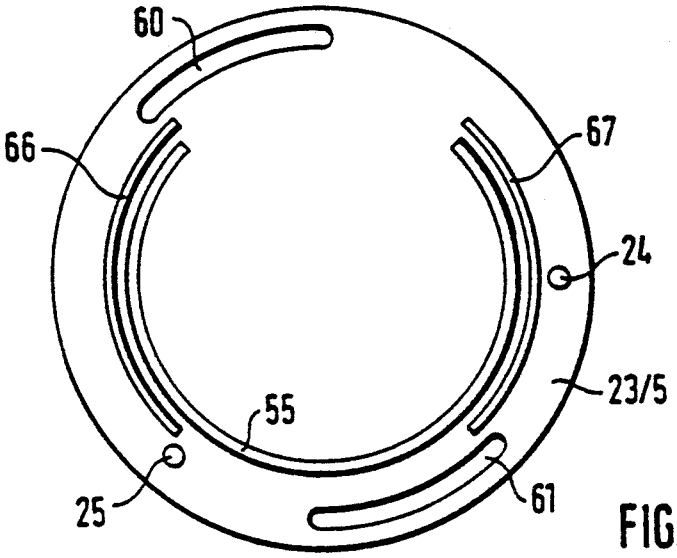

FIGS. 12, 13, and 14 show schematically three more embodiments of security revolving door assembly for persons, which will be discussed in greater detail below.

As was mentioned above, during the correct passage of a person, the revolving doors 10 or 21 or 22 in all embodiments are driven in the direction in which the person in question, who is authorized to pass through, will pass through the respective passage sector 12 or 12/1 or 12/2 or 13/2. However, to prevent accidents, the electrical drive is designed such that the revolving door can be stopped or even turned in the opposite direction when necessary. However it is also ensured by appropriate control means that after a completed or attempted passage, the revolving door will again be rotated to the next defined resting position and stopped there. These resting positions of the revolving door 10, 21, and 22 can be secured by electrically controlled braking or locking devices. However, to prevent accidents, the stopping torque shall be only so strong that it can be overcome by one person if necessary, i.e., one person shall be able to turn the revolving door 10, 21 or 22 manually, even without electrical drive.

Based on these conditions, if no additional devices are present, such revolving door assemblies for persons can be overcome by unauthorized persons in an incorrect manner. To avoid these disadvantages and to ensure that only authorized persons are able to pass through these security revolving door assemblies, for persons to enter a protected room or to leave a protected room, and to also make it possible at the same time to provide a monitor that permits determining the number of persons having entered or left the protected room, i.e., the number of persons who are in the protected room at any given time, an additional blocking device is provided, which will be explained in greater detail below.

In all embodiments, this blocking device has a blocking disk 23 or 23/1 or 23/2, which, as shown in FIG. 3, is arranged above a revolving door, e.g., the revolving door 10, concentrically to its central axis 6 and is rigidly connected to the revolving door, and which is provided with circular arc-shaped recesses of a defined circumferential length, wherein the number of the recesses corresponds to the number of defined resting positions of the corresponding revolving door 10, 21 or 22, and two locking bolts 24 and 25 are associated with the recesses. The locking bolts 24 and 25 are individually controllable by electromagnets 68 and 69 and can be placed alternately into one of the recesses. In the case of the blocking disk 23, shown in FIGS. 3 and 4, the recesses case of the three slot-shaped recesses 26, 27, and 28, and in the case of the blocking disk 23/1. The recesses are the four recesses 29, 30, 31 and 32, and in the case of the blocking disk 23/2. The recesses the only two recesses 33 and 34. The ends of the recesses 26 through 34 form respective stop face pairs 26/1–26/2, 27/1–27/2, 28/1–28/2 or 29/1–29/2 or 30/1–30/2 or 31/1–31/2 or 32/1–32/2 or 33/1–33/2 and 34/1–34/2, which come into contact with an activated locking bolt 24 or 25 and are then able to block the revolving door 10, 21 or 22 in one rotation direction or another. In FIGS. 4, 9, 10 and 11, the locking bolts 24 and 25 are represented as circles.

Figure 9:
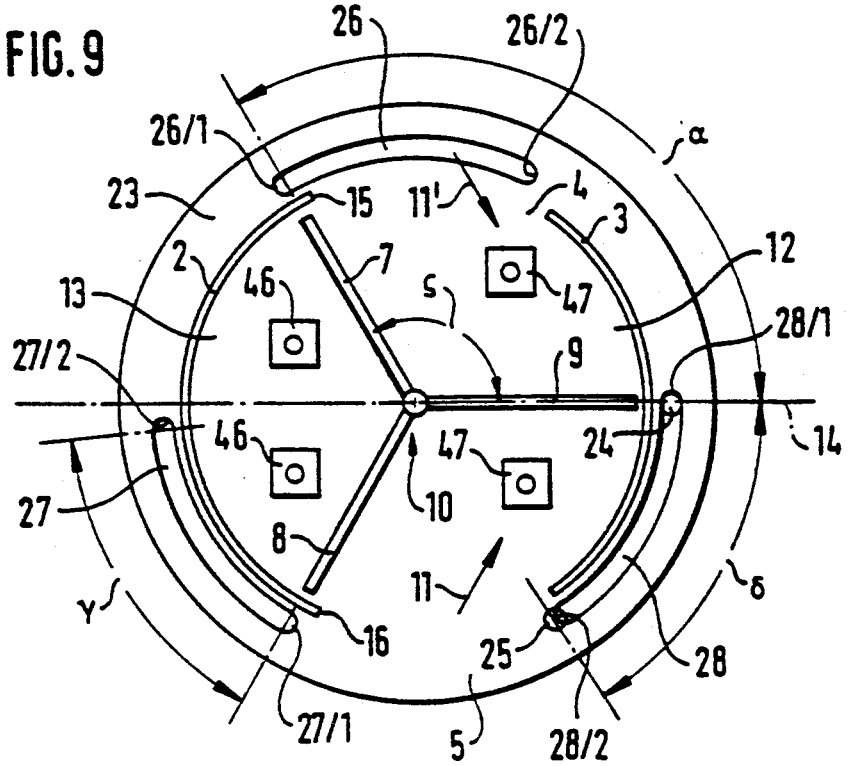
FIG. 9 is a schematic top view of a security revolving door assembly for an arrangement provided with a three-flap revolving door and a blocking disk arranged concentrically to it.

As is apparent from FIGS. 9 and 10, the recesses 26, 27, and 28 or 29 through 32, as well as 33 and 34 extend over a so-called free-wheeling angle gamma ($\gamma$) or gamma'($\gamma'$) or gammal ($\gamma$1) which is approximately half the sector angle beta ($\beta$) or beta'($\beta'$) or betal ($\beta$1) of the passage sector 12, 12/1 or 12/2 of the respective security revolving door assembly for persons. This guarantees that the blocking disks 23 or 23/1 or 23/2 are still freely rotatable by precisely this free-wheeling angle gamma or gamma' or gammal in one rotation direction or another even when the locking bolt 24 or 25 extends into one of the recesses 26 through 34. The fact that the locking bolts 24 and 25 are located on the same radii as the recesses 26 through 34 arises from the condition that they are intended to drop into them. Another condition is that the stop face pairs 26/1–26/2, 27/1–27/2, 28/2–28/2 or 29/1–29/2 or 30/1–30/2 or 31/1–31/2 or 32/1–32/2 or 33/1–33/2 and 34/1–34/2, which are formed by the ends of the 25 recesses 26 through 34, shall always be located—in the same locking disk 23, 23/1, and 23/2—in a so-called blocking plane into which the two locking bolts 24 and 25 can be placed individually and alternately in order to exert their stopping or blocking effect.

In the embodiments, according to FIGS. 9 and 10, the distance angle delta ($\delta$)and delta ', which is enclosed between the two locking bolts 24 and 25, is selected to be somewhat greater than half the sector angle beta ($\beta$) or beta'($\beta'$) (FIGS. 6 and 7) of the passage sector 12 or 12/1, and consequently also greater than the respective associated free-wheeling angle gamma ($\gamma$) or gamma'($\gamma'$). It is thus ensured that only one of the two locking bolts 24 or 25 can extend into one of the recesses 26 through 28 or 29 through 32 at any one time. This condition can also be satisfied with other means, e.g., circuit means, or with additional mechanical blocking devices.

In the embodiment according to FIG. 11, in which the blocking disk 23/2 has only two diametrically opposed recesses 33 and 34, the distance angle deltal ($\delta 1$) between the two locking bolts 24 and 25 is selected to be such that it is slightly greater than the sum of the free-wheeling angle gammal ($\gamma 1$) and the door flap angle phi ($\rho$). Thus, the condition that only one of the two locking bolts 24 or 25 is able to drop into one of the two recesses 33 or 34 at any one time is met here as well.

In the two embodiments according to FIGS. 6 and 9 as well as 7 and 10, the defined selection of the wall shells 3 and 3/1 defining the passage sectors 12 and 12/1, respectively, and of o the corresponding sector angle beta ($\beta$) or beta'($\alpha'$) in relation to the value of the door flap angle phi ($\rho$) ensures that at most a difference gap S of 20 1 cm (cf. FIG. 9*d* and FIG. 10*d*) can form when the respective trailing door flap enters the area of the sector angle beta ($\beta$) or beta'($\beta'$). This value of the difference gap S guarantees that a person located in the passage sector will be unable to leave it when the door is blocked in this position, e.g., by placing the locking bolt 24 into the recess 28 or 32.

On the other hand, when the revolving door 10 or 21 is thus blocked in one rotation direction, the revolving door 10 or 21 can be turned back in the opposite direction far enough so that the person located in the passage sector 12 or 12/1 will be able to leave it through the passage opening 4 or 5 or 4/1 or 5/1, through which he had entered.

To control an electric motor 40 driving the revolving door 10 or 21 or 22 and an electromagnetic brake 41, as well as the two electromagnets 68 and 69 of the locking bolts 24 and 25, the switching device shown schematically in FIG. 5 is provided. This has a microprocessor 42, to which two ID card readers 43 and 44 (cf. FIG. 2), a position transducer 45, as well as a plurality of space sensors 46 and 47 arranged in the blocking sector 13, 13/1 and passage sector 12, 12/1 or 12/2 are connected as peripheral control devices. The space sensors 46 and 47 are usually arranged on the ceiling 48 of the door housing 1, 1/1 or ½, and they are able to signal whether only one person or more than one person is located in one passage sector or in one blocking sector, so that the microprocessor 42, which is supplied with their signals, is able to send corresponding control signals to the electromagnets 68 and 69 of the locking bolts 24 and 25 in order to allow one of the locking bolts 24 or 25 to drop into one of the recesses 26 through 34 of the individual blocking disks 23, 23/1 or 23/2.

However, the space sensors 47 of the passage sectors can also be designed such that they send blocking signals to the microprocessor when an otherwise authorized person is carrying prohibited objects.

Figure 9A:
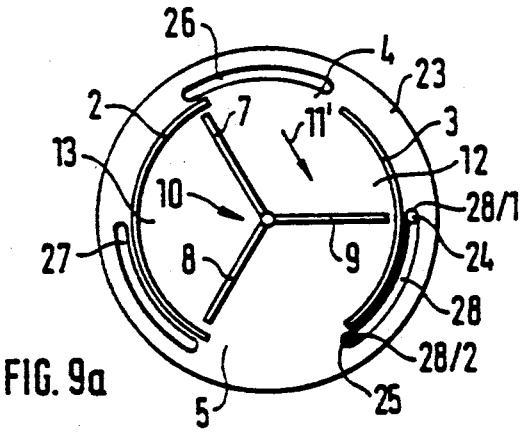
FIG. 9*a* through 9*g* are views showing seven different positions of the three-flap revolving door according to FIG. 9.
Figure 9B:
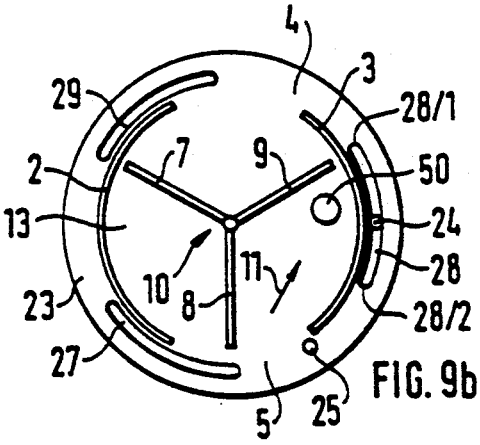

FIGS. 9*a* through 9*g* show different control states of the blocking device consisting essentially of the control disk 23 and the two locking bolts 24 and 25. Representation of the locking bolt 24 or 25 as a black circle means that the locking bolt in question is activated, i.e., has been brought into the blocking position and consequently extends into one of the recesses 26, 27 and 28. FIG. 9*a* shows the starting or resting position of the revolving door 10, which is shown in FIG. 9. Neither of the two locking bolts 24 and 25 is activated. The slot-shaped recess 28 is in an angular position in which the locking bolt 24 is located immediately next to the stop face 28/1, so that in this resting position of the revolving door 10, it would be able to drop into the recess 28. It is thus possible to block the revolving door 10 in its resting position in one rotation direction, for example, when it is desired that no other person shall enter the protected room.

The other locking bolt 25 is located approximately above the other stop face 28/2, so that this locking bolt cannot drop in.

Assuming a person 50, who has been shown to be authorized to pass through by an identification card placed into the card reader 44, enters the passage sector 12 through the passage opening 5 in the direction of arrow 11, the drive motor 40 is turned on in the rotation direction indicated by arrow 11 as soon as this person 50 has been detected by the first space sensor 47. If the space sensors detect during passage that this person is not alone or that he is carrying a prohibited object, the microprocessor receives a corresponding signal, by which the locking bolt 24 is activated and lowered into the recess 28, which takes place, e.g., in the rotary position shown in FIG. 9*b*. Along with the activation of the locking bolt 24, the motor 40 is also turned off and the brake 41 is turned on. The revolving door is stopped. If the person 50 in question now attempts to reach the passage opening 4 by continuing to rotate the revolving door 10 manually in the direction of arrow 11, the revolving door will be blocked in the position shown in FIG. 9*c* due to the trailing end of the recess 28, i.e., the stop face 28/2, striking the activated locking bolt 24 and the blocking disk 23 preventing the revolving door 10 from rotating further. However, due to the length of the recess 28, the person 50 standing in the passage sector 12 is able to push back the revolving door 10 in the opposite direction so far that he will be able to leave the door housing 1 through the passage opening 5, through which he had entered.

However, if the authorized person 50 is not accompanied by an unauthorized person or is not carrying any prohibited objects, the locking bolt 24 will not be activated; the authorized person is able to leave the door housing 1 through the passage opening 4 while the revolving door 10 rotates into its next resting position and stops there, controlled by the position transducer 45.

Figure 9C:
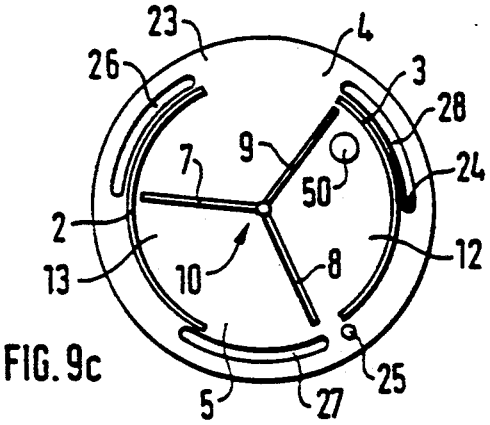
Figure 9D:
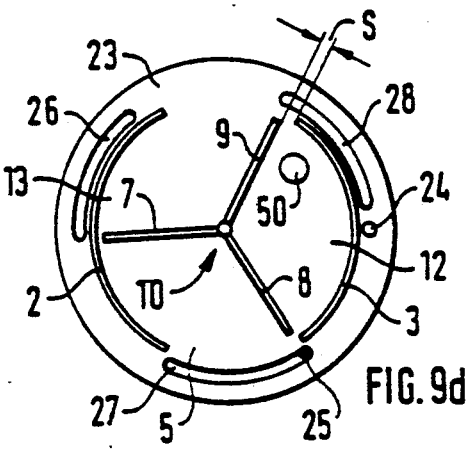
Figure 9E:
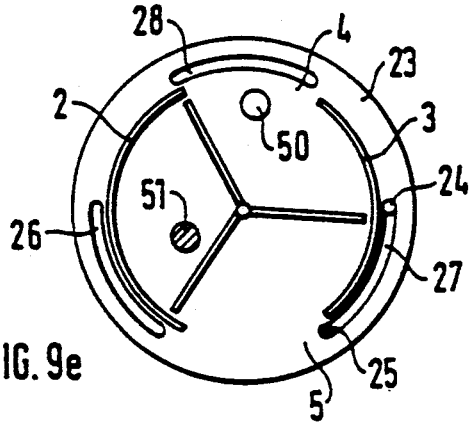

As soon as the position of the revolving door 10 shown in FIG. 9*d* is reached, in which one door flap 9 forms a difference gap S of ca. 20 cm with one end edge of the wall shell 3, the next recess 27 with its leading stop face 27/1 reaches the locking bolt 25, so that beginning from this position, the locking bolt 25 can be activated and placed into the recess 27. If this happens, the revolving door 10 can no longer be turned back from this position. This is important as it makes it impossible for an unauthorized person to enter the passage sector 12 in the opposite direction and to turn back the revolving door 10 manually against the drive now in operation. In addition, this reverse blocking is also important when reliable counting of the persons located in a protected room is to be performed. It can thus be ensured that each person who wishes to pass through the revolving door assembly in the opposite direction must first reactivate the card reader located on the other side.

Figure 9F:
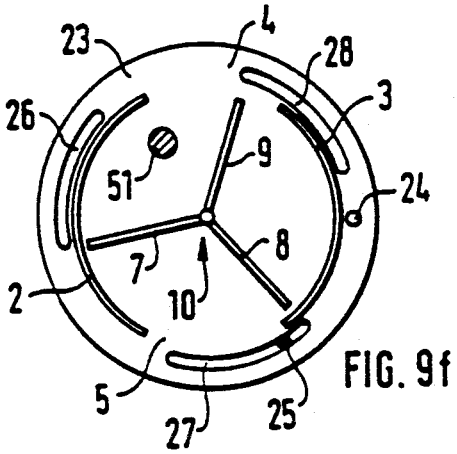
Figure 9G:
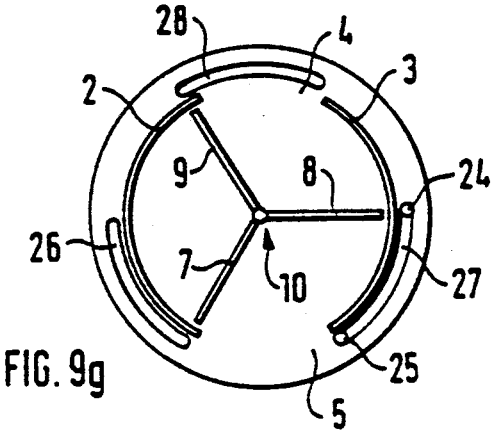

Using a space sensor 46 arranged in the blocking sector 13, it is also possible to prevent an unauthorized person 51 from reaching the passage opening 5 through the blocking sector 13 during the rotation of the revolving door 10 in the direction of arrow 11, while an authorized person 50 is passing through the passage sector 12, by activating the locking bolt 25 and placing it into the recess 27. FIG. 9 shows in this connection that the trailing stop face 27/2 arriving at the activated locking bolt 25 stops the revolving door 10 before the door flap 7 leaves the blocking sector 13. The revolving door 10 with the blocking disk 23 can be turned back against the rotation direction indicated by arrow 11 from this blocked position, while the locking bolt 25 is activated. The distance it can be turned back is enough so that the unauthorized person 51 is again able to leave the door housing 1 through the passage opening 4, as is indicated in FIG. 9*f*. In FIG. 9*c*, the revolving door 10 assumes the resting position following a passage in the direction of arrow 11 relative to the resting position shown in FIG. 9*a*.

This arrangement of the recesses 26, 27 and 28, and of the locking bolts 24 and 25 also guarantees that blocking of the revolving door in the rotation angle zones of the revolving door 10, in which the risk of being jammed between a door flap 7, 8, 9 and an edge of the wall shell is present, is ruled out.

This condition is also met in the other embodiments of the present invention.

The described mode of operation of the blocking device also takes place during passage in the opposite direction, i.e., in the direction of arrow 11', the difference being that the functions of the two locking bolts 24 and 25 are interchanged. In this case, the inserted locking bolt 25 prevents the passage opening 5 from being reached in the angular position shown in FIG. 9*d*; the inserted locking bolt 24 prevents the revolving door 10 from being turned back in the angular position shown in FIG. 9*c*. The unauthorized passage through the blocking sector 13 is also prevented analogously by means of the two locking bolts 24 and 25 and the recesses 26, 27, and 28.

It can be recognized from FIGS. 10*a*through 10*h* that the revolving door 21 can be blocked in angular positions analogous to the revolving door 10 by corresponding alternate activation of the two locking bolts 24 and 25 in the case of the security revolving door assembly for persons according to the embodiments shown in FIG. 10 as well.

Figure 10A:
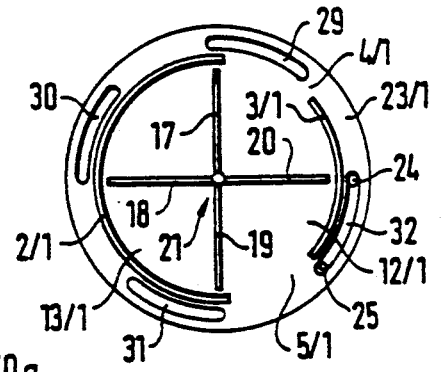
FIG. 10*a* through FIG. 10*h* are views showing eight different rotary positions of the revolving door according to FIG. 10.
Figure 10B:
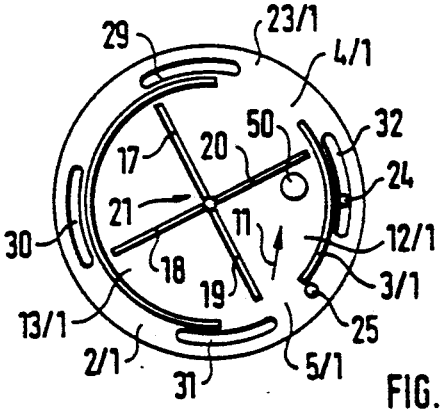
Figure 10C:
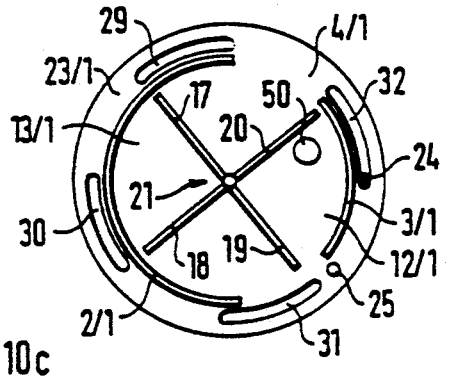
Figure 10D:
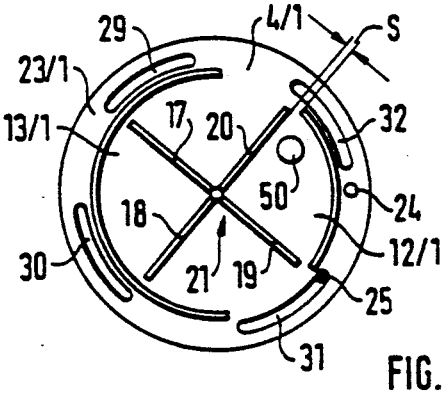
Figure 10E:
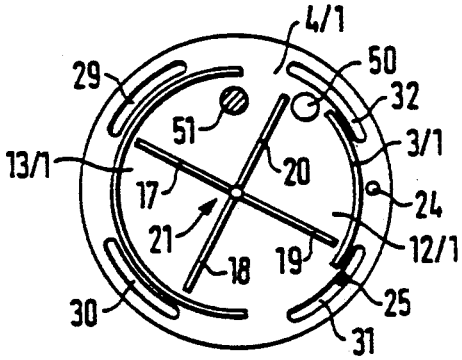
Figure 10F:
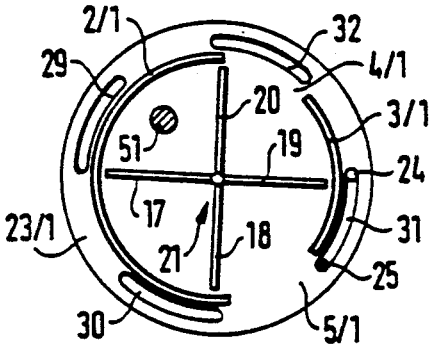
Figure 10G:
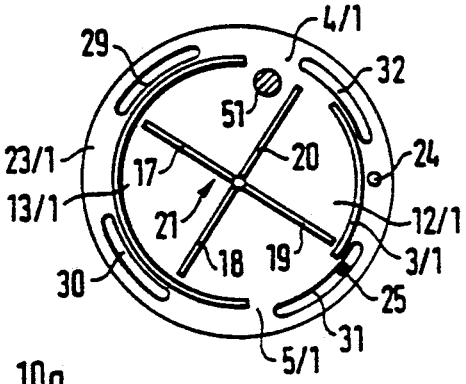

While FIG. 10*a* shows the resting position of the revolving door 10, the revolving door 10 in FIG. 10*b* is put into motion in the direction of arrow 11 after an authorized person 50 has entered the passage sector 12/1 through the passage opening 5/1. FIG. 10*c* shows that blocking of the revolving door 21 can be achieved by activating the locking bolt 24 that is now dropping into the recess 32 before the passage opening 4/1 is released, and that the revolving door 21 can be turned back from this blocked position by the length of recess 32 in order for the person 50, who is either accompanied by an unauthorized person or is carrying prohibited objects, to be prevented from passing through and to be able to leave through the passage sector in the reverse 25 direction. FIG. 10*d* shows the angular position of the revolving door 21 and of the blocking disk 23/1 in a position in which the difference gap S has just been reached between one door flap 20 and the wall shell 3/1 defining the passage sector 12/1, and in which the locking bolt 25 is first able to drop into the recess 31. Beginning from this position of the revolving door 21, it is possible to prevent the revolving door 21 from being turned back by activating the locking bolt 25, but also to make it possible at the same time for the person 50 passing through to leave the passage sector 12/1 through the passage opening 4/1. By suitably activating the locking bolt 25, it is also possible to prevent an unauthorized person 51 from reaching the passage opening 5/1 through the blocking sector 3/1 by the locking bolt 25 falling into the recess 31, blocking the revolving door 21 before it has reached its next resting position. However, the unauthorized person 51 now located in the upper half of the blocking sector 13/1 is still able to turn back the door manually in the opposite direction so far that he can leave the blocking sector 13/1 through the passage opening 4/1, as is shown in FIG. 10*d*.

Figure 10H:
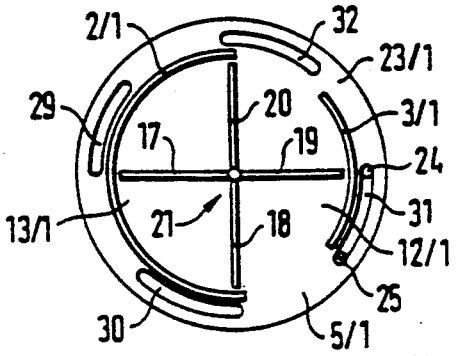
Figure 11A:
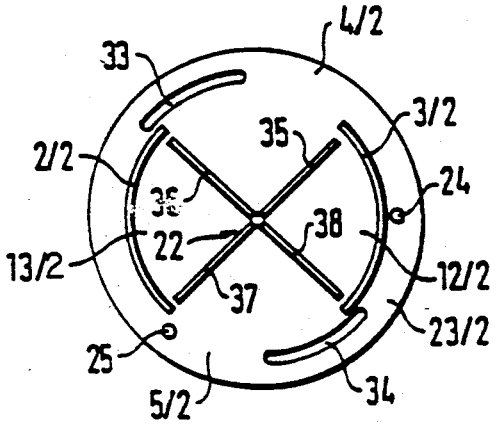
Figure 11B:
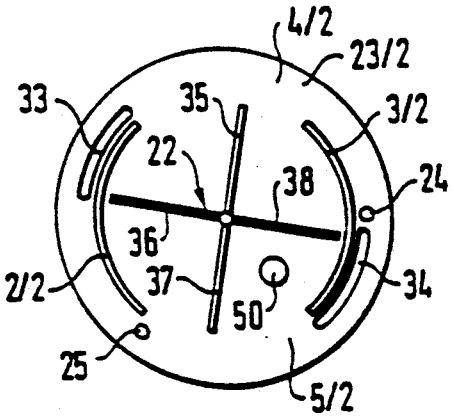
Figure 11C:
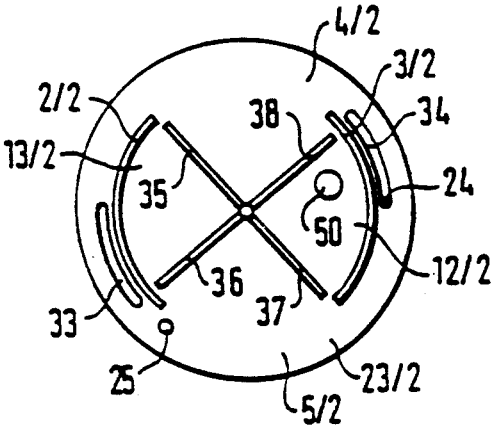
Figure 11D:
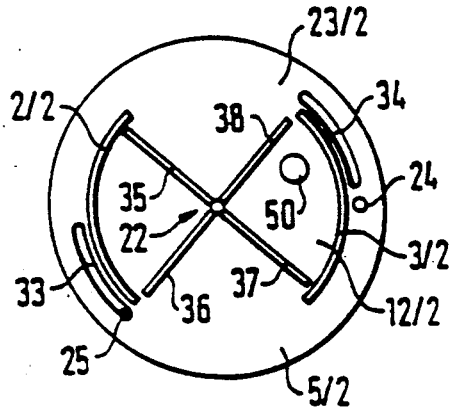
Figure 11E:
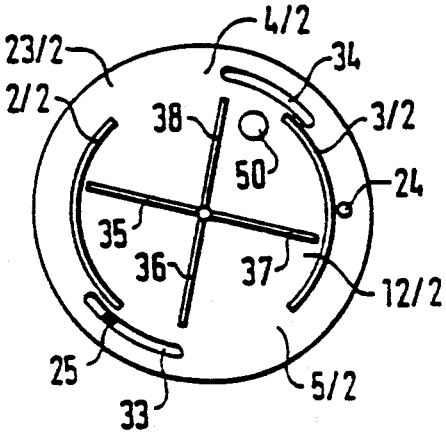
Figure 11F:
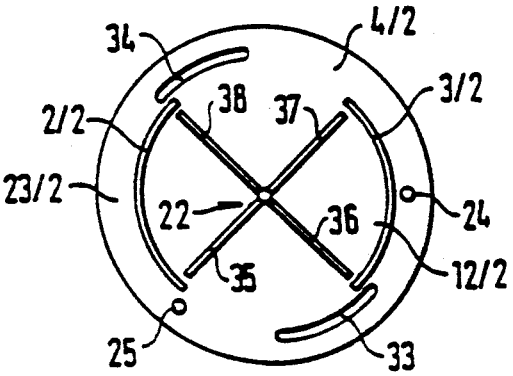
Figure 11G:
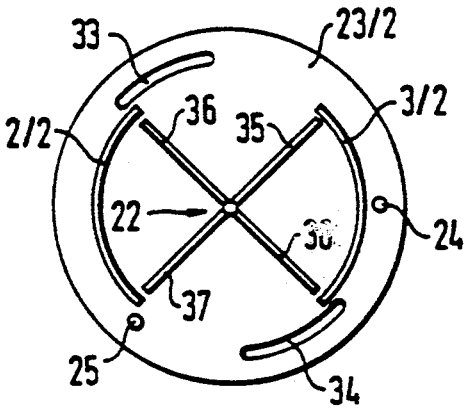
Figure 11H:
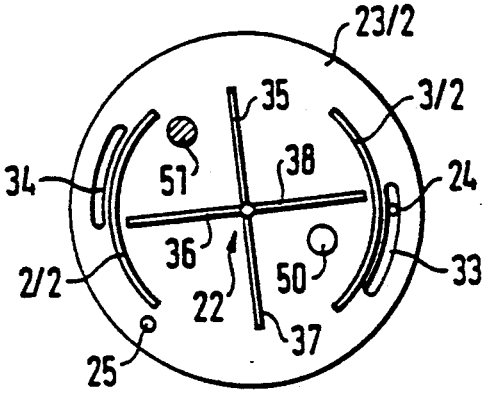
Figure 11I:
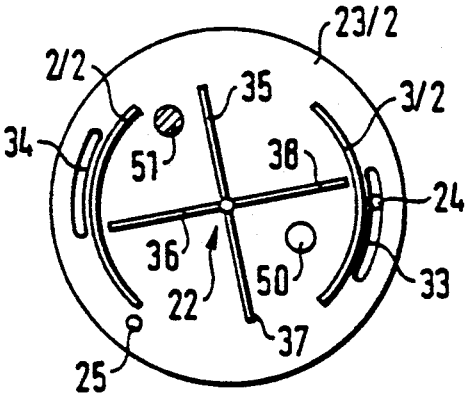
Figure 11K:
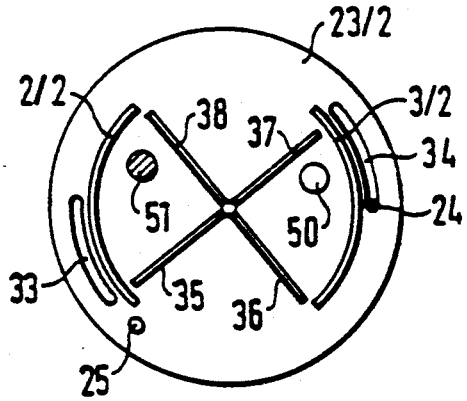
Figure 11L:
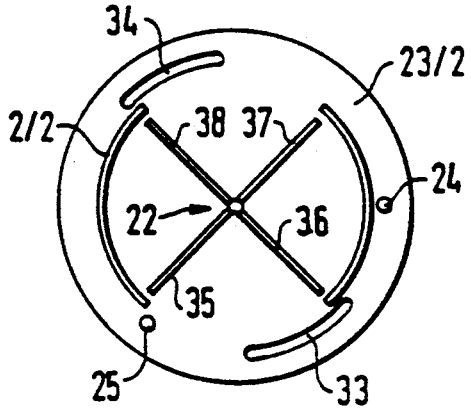

FIG. 10*h* shows the revolving door 21 in its resting position offset through 90° relative to FIG. 10*a*.

FIGS. 11*a* through 11*l* show different phases of the operation of the blocking device of the security revolving door assembly for persons shown schematically in FIG. 11, in which the revolving door 22, provided with four door flaps 35 through 38, assumes two 25 defined resting positions offset by 180°, and whose blocking disk 23/2 is consequently provided with only two recesses 33 and 34. The further peculiarity of this security revolving door assembly for persons is the fact that it has two passage sectors 12/2 and 12/3, which are exactly diametrically opposite each other, but for which the blocking device described offers the same security against unauthorized passages. When, in the resting position 11*a*, an authorized person 50, who has identified himself with an ID card at the card reader 44, enters into the inside of the door housing 1/2 through the passage opening 5/2 in the direction of arrow 11, he is detected by a space sensor 47, and the revolving door 22 is set into motion in the counterclockwise direction. If no objection arises during the further monitoring by the sensor, the authorized person 50 is able to pass through the passage sector 12/2 and leave it through the passage opening 4/2. However, if—during the further monitoring by the sensor—the person 50 is found to be accompanied by an unauthorized person or carrying a prohibited object, the revolving door 22 can be blocked against further rotation in the direction of passage in the position shown in FIG. 11*c* by corresponding activation of the locking bolt 24, which now drops into the recess 34. Otherwise, by correspondingly activating the locking bolt 25, which will now drop into the recess 33, the revolving door 22 can be reliably prevented from being turned back, which is important inasmuch as simulating ordinary passage by a person 50 can thus be ruled out. When the locking bolt 25 is activated, the person 50 is no longer able to leave the door in the reverse direction. He is able to leave the revolving door only through the opposite passage opening 4/2. As is shown in FIGS. 11*a* through 11*l*, using the locking bolt 24, it is also possible to prevent an unauthorized person 51 from passing through the passage sector 13/2 while the authorized person 50 is passing through the passage sector 12/2. This is achieved by the activated locking bolt 24 falling into the recess 34 and blocking the revolving door 22 as long as the unauthorized person is still located in the passage sector 13/2. The only possibility left now is to turn back the revolving door 22 in the opposite direction in order for the unauthorized person 51 to leave the passage sector 13/2 in the opposite direction. The authorized person 50 is able to complete his passage only after this has happened, after which the revolving door 22 will assume the second resting position shown in FIG. 11*l*.

The principle of the above-described blocking device can also be applied in a similar manner to revolving doors of the type shown in FIGS. 12, 13, and 14, which share the common feature that their revolving doors 53 and 54 revolving cylinder 55 have revolving cylinders 55 with only two resting positions offset by 180° relative to one another. In all three cases, the passage release members, namely, the revolving doors 53 or 54 or the revolving cylinder 55, can be turned in one direction only. The blocking disks 23/3 or 23/4 or 23/5, which are arranged concentrically to the axes of the revolving doors 53 or 54 or the revolving cylinder 55, are provided with only two, diametrically opposed recesses 56 and 57 or 58 and 59 or 60 and 61, each of which is associated with two locking bolts 24 and 25. In these embodiments, the door housings 23/3, 23/4 and 23/5 are formed by diametrically opposite wall shells 62 and 63 or 64 and 65 or 66 and 67 of equal size, so that in terms of function, the relations are approximately the same as in the security revolving door assembly for persons shown and explained in FIGS. 8 and 11 or in FIGS. 11*a* through 11*l*.

Due to the fact that the revolving doors 53 and 54 are provided, at the ends of their door flaps, with asymmetric closing segments 70 or with symmetrical shell segments 71, the passage openings 4/3 and 5/3 or 4/4 and 5/4 are temporarily completely closed during the passages in these security revolving door assemblies for persons.

While specific embodiments of the invention have been shown and described in detail to illustrate the application of the principles of the invention, it will be understood that the invention may be embodied otherwise without departing from such principles.

What is claimed is:

1. A security revolving door assembly, comprising:

a cylindrical door housing including two wall shells which define one blocking sector and one passage sector and leave open two opposite passage openings; a revolving door passage release member that can be revolved on a vertical central axis of the door housing from defined resting positions and can be driven by a motor, the revolving door including one of plural door flaps and a revolving cylinder with at least a passage opening; a blocking disk including a circular arc provided around the central axis of the door housing and including at least one pair of stop faces on each side of a bolt receiving region, one stop face acting in a forward direction of said bolt receiving region and one stop face acting in a reverse rotation direction of said bolt receiving region, said blocking disk being in a rigid rotary connection with the revolving door passage release member via one of a gear mechanism and a direct connection two stationary locking bolts which may be selectively individually placed between two stop faces of said pair of stop faces of the blocking disk, the distance between the two stop faces in the bolt receiving region of each stop face pair corresponding to a free wheeling angle which is at least large enough to allow said blocking disk to revolve approximately through half a sector angle defined by the passage sector, when the locking bolt has been placed into the blocking disk; and, control means for controlling the position of said locking bolts.

2. A security revolving door assembly according to claim 1, wherein said stop faces are formed by the ends of one or more arc-shaped openings of the blocking disk.

3. A security revolving door assembly according to claim wherein a member of stop face pairs of one blocking disk corresponds to the number of defined resting positions of the passage release member, the angular distance between individual stop face pairs corresponding to the angular distance of the passage release members.

4. A security revolving door assembly according to claim 1, wherein said locking bolts provided spaced an angular distance from each other which is greater than the distance angle of between the two stop faces of a stop face pair by at least so much that only one of the two blocking bolts can be placed between two stop faces of one or more stop face pair, at a time.

5. A security revolving door assembly according to claim 1, wherein for each passage release member having more than two defined resting positions, two locking bolts are arranged such that in each defined resting position of the passage release member one of the locking bolts can drop into the blocking disk immediately behind a stop face acting in said reverse rotation direction.

6. A security revolving door assembly according to claim 1, wherein for each revolving door with three or more flaps, the wall shell defining the passage sector extends symmetrically to the resting position of a door flap through a sector angle that is smaller than the door flap angle by at most so much that a maximum difference gap (S) of 20 cm will be obtained.

7. A security revolving door assembly, comprising:

a cylindrical door housing including two wall shells; a rotatable passage release member that can be revolved on a vertical central axis of the door housing from defined resting positions and can be driven by a motor the passage release member including a revolving door with plural door flaps, said rotatable passage release member cooperating with said wall shells to define a blocking sector and a passage sector; a blocking disk including a circular arc provided around the central axis of the door housing and including at least one pair of stop faces, one stop face acting in a forward direction and one stop face acting in a reverse rotation direction, said blocking disk being in a rigid rotary connection with the rotatable passage release member to act as an additional blocking device; two stationary locking bolts which may be selectively individually placed between two stop faces of said pair of stop faces of the blocking disk, the distance between the two stop faces of each stop face pair corresponding to a free wheeling angle which is at least large enough to allow said rotatable passage release member to revolve approximately through half a sector angle defined by the passage sector, when the locking bolt has been placed into the circular arc of the blocking disk; and, control means for controlling the position of said locking bolts.

8. Security revolving door assembly, comprising:

a cylindrical door housing including two wall shells; rotatable door means positioned within said cylindrical door housing and cooperating with said wall shells to define movable sectors including a blocking sector in which the door and wall shells prevent ingress and egress from said cylindrical door housing and a passage sector in which one of ingress or egress are possible through one of two opposite passage openings defined by said two wall shelves; blocking means connected to said door means for rotation therewith, said blocking means including a first stop element and a second stop element; blocking bolt means including a bolt element selectively positionable between said first stop element and said second stop element for engaging one of said first stop element and said second stop element, said stop elements being positioned allowing rotation of said door by a free wheeling angle which is at least large enough for said rotatable door means to revolve approximately through half a sector angle defined by said passage sector when said blocking bolt means has been selectively positioned between said first and second stop elements; and, control means for controlling a position of said locking bolt.

* * * * *